US007021237B1

(12) United States Patent
Benjamin

(10) Patent No.: US 7,021,237 B1
(45) Date of Patent: Apr. 4, 2006

(54) VEHICLE GARAGE GUARD #2

(76) Inventor: Gregory Benjamin, Logistics Automation, APO (AE) 09366

( * ) Notice: Subject to any disclaimer, the term of this patent is extended or adjusted under 35 U.S.C. 154(b) by 98 days.

(21) Appl. No.: 10/771,301

(22) Filed: Feb. 5, 2004

(51) Int. Cl.
*E04H 6/42* (2006.01)

(52) U.S. Cl. ..... 116/28 R; 404/9

(58) Field of Classification Search ..... 116/28 R, 116/173, DIG. 16, 63 R, 63 P; 340/932.2; 404/9; 184/106; 33/264
See application file for complete search history.

(56) References Cited

U.S. PATENT DOCUMENTS

| | | | | |
|---|---|---|---|---|
| 2,296,311 | A * | 9/1942 | Schneider | 116/28 R |
| 2,784,692 | A * | 3/1957 | Ballesteros | 116/28 R |
| 3,121,416 | A * | 2/1964 | Gizdich | 116/28 R |
| 3,368,518 | A * | 2/1968 | Anthony | 116/63 R |
| 3,922,638 | A * | 11/1975 | Mendelsohn | 340/932.2 |
| 4,194,724 | A * | 3/1980 | Masegian | 254/88 |
| 4,246,982 | A * | 1/1981 | Pretnick | 184/106 |
| 4,433,636 | A * | 2/1984 | Crouch | 116/28 R |
| 4,813,758 | A | 3/1989 | Sanders | 359/515 |
| 4,870,413 | A * | 9/1989 | Walden et al. | 340/932.2 |
| 5,127,357 | A | 7/1992 | Viskovick | 116/28 R |
| 5,221,380 | A * | 6/1993 | Wilson et al. | 152/213 R |
| 5,231,392 | A * | 7/1993 | Gust | 340/932.2 |
| 5,285,205 | A | 2/1994 | White | 340/932.2 |
| 5,341,132 | A * | 8/1994 | Dorey et al. | 340/932.2 |
| 5,478,625 | A * | 12/1995 | Wright | 428/119 |
| 5,556,692 | A * | 9/1996 | Zheng | 428/156 |
| 5,816,743 | A * | 10/1998 | Schmitz, Jr. | 405/53 |
| 5,841,368 | A * | 11/1998 | Bryant | 340/932.2 |
| 6,062,162 | A * | 5/2000 | Dean | 116/28 R |
| 6,154,150 | A | 11/2000 | Laubach | 340/932.2 |
| 6,301,848 | B1 * | 10/2001 | Whitaker | 52/302.1 |
| 2003/0112514 | A1 * | 6/2003 | D'Onofrio | 359/515 |

* cited by examiner

*Primary Examiner*—R. Alexander Smith
(74) *Attorney, Agent, or Firm*—Patent & Trademark Services, Inc.; Joseph H. McGlynn

(57) ABSTRACT

A parking guide having both visual and auditory indicators to show a driver when a vehicle is properly positioned in a parking space.

8 Claims, 2 Drawing Sheets

VEHICLE GARAGE GUARD #2

BACKGROUND OF THE INVENTION

This invention relates, in general, to devices which assist in parking a vehicle in a garage, and, in particular, to floor guides which have an auditory and visual guide for proper placement of a vehicle in a garage or other parking space.

DESCRIPTION OF THE PRIOR ART

In the prior art various types of parking devices have been proposed. For example, U.S. Pat. No. 6,154,150 to Laubach discloses a projection unit mounted above a parking position which projects a beam of light onto the parking position. A detection unit detects the light and a motion detector actuates the projector.

U.S. Pat. No. 5,285,205 to White uses a laser that emits a beam over the path a vehicle is to take to guide the driver into position.

U.S. Pat. No. 5,127,357 to Viskovick discloses a mirror affixed adjacent a garage door which reflects the vehicles brake lights and rear bumper.

U.S. Pat. No. 4,813,758 to Sanders discloses a metal plate mounted with a fastener to a supporting surface and lateral positioning members for ensuring proper lateral vehicle positioning.

Garage-parking guides have been in use for years. Typically, garage-parking guides are comprised of either physical levels, electrical connections or hanging devices that activate on visual and/or audible signals. Previous and current garage-parking guides have required precise installation and adjustments for a particular vehicle, and/or driver.

The main problem with conventional garage parking guides is that positioning a vehicle in an enclosed garage requires attention and precision. Parking a vehicle in a confined space requires, but is not limited to, the following conditions:

1) Vehicle must be parked to allow clearance for the garage door to close. The clearance should be minimal.
2) Vehicle should be parked to permit maximum use of garage space for storage of tools, lawn equipment and other household items.
3) Driver should allow space for movement around the vehicle.
4) Driver must also avoid hitting internal walls and other objects in the garage that may lead to damage of structure, equipment and/or vehicle.

A simplistic garage guide is needed to provide the driver with a signal to let the driver know when he or she has reached the proper location in which to park. The guide should be universal so that it will work for any driver attempting to park the vehicle. Conventional garage parking guides have physical signal producing devices that interfere with use of garage space. They are unsightly and require high maintenance. The audible signal devices are often irritating to the household and neighborhood, and they are expensive.

SUMMARY OF THE INVENTION

The present invention is directed to a parking guide having both visual and auditory indicators to show a driver when a vehicle is properly positioned in a parking space.

It is an object of the present invention to provide a new and improved parking guide.

It is an object of the present invention to provide a new and improved parking guide which has both visual and auditory parking indicators.

It is an object of the present invention to provide a new and improved parking guide which can be easily and quickly mounted in any garage.

These and other objects and advantages of the present invention will be fully apparent from the following description, when taken in connection with the annexed drawings.

DESCRIPTION OF THE PREFERRED EMBODIMENT

Figure 1:
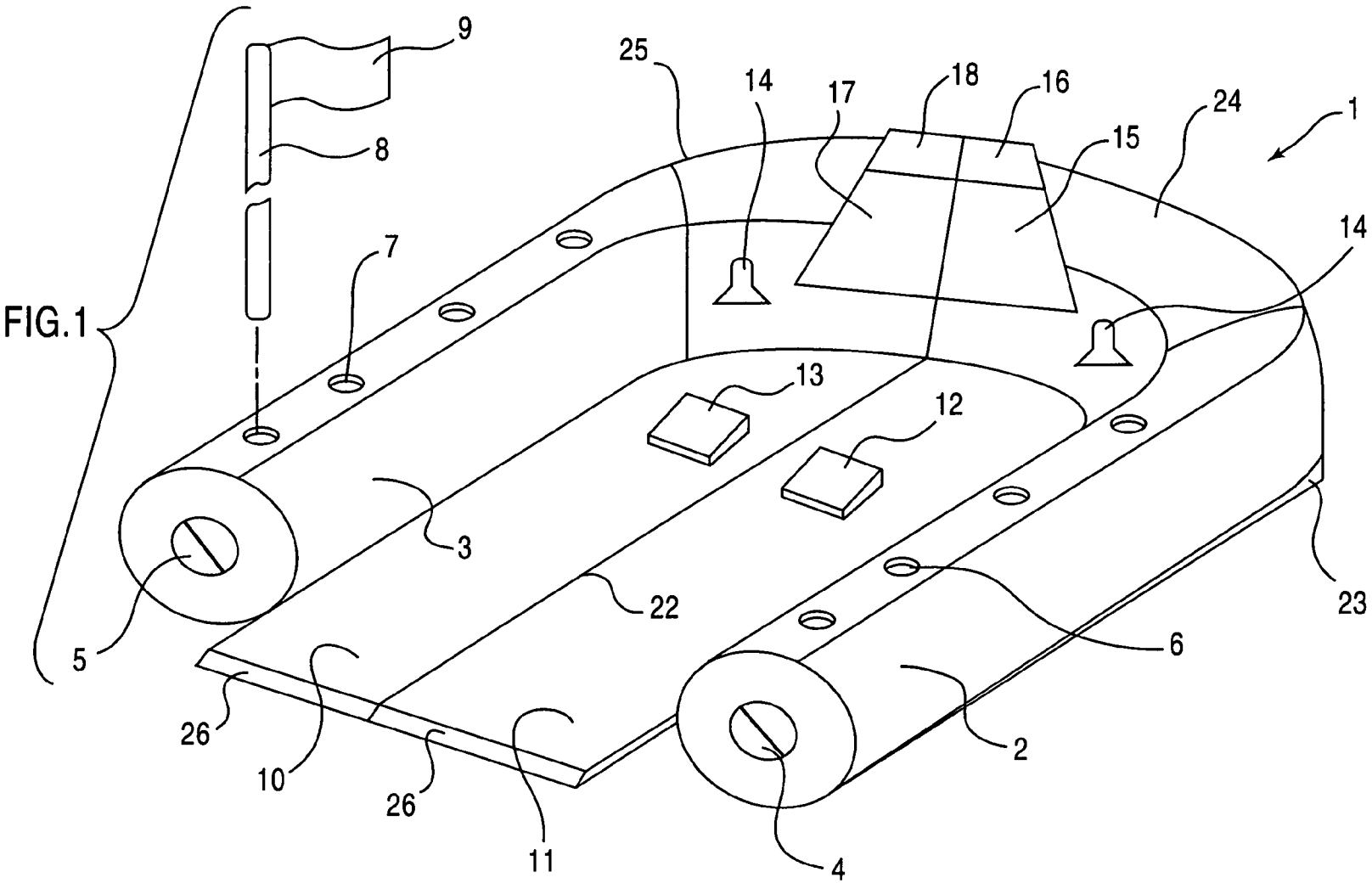
FIG. 1 is perspective view of the present invention.
Figure 3:
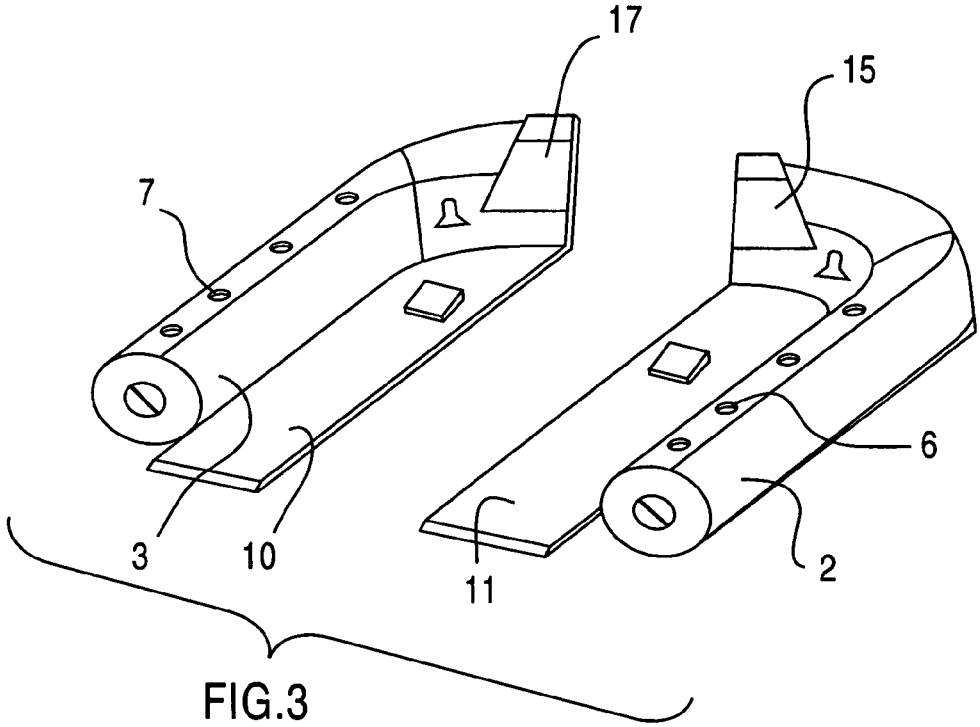
FIG. 3 is a partial view of the present invention showing the device separated so it can be used on two tires or two vehicles.

Referring now to the drawings in greater detail, FIG. 1 shows a perspective view of the parking guide of the present invention 1. The guide is made in two substantially identical parts and joined at a center line 22. The two halves can be secured together in any conventional manner if the user wants to use the device as a single guide. Alternatively, the user could separate the two halves and use each half independently as shown in FIG. 3. One half could be used for the front left side tire and the other half could be used for the front right side tire, or the halves could be used with a single tire on two different vehicles.

The guide has a pair of side walls 2, 3 a pair of floor sections 10, 11, and a pair of back sections 24, 25. The side walls 2, 3 are hollow and have an access door 4, 5 to allow ballast such as, but not limited to, water, sand, cement, etc to be placed inside to help anchor the guide to a floor. In addition, each floor section 10, 11 has an adhesive pad 23 on the bottom of the floor section which can be adhesively attached to the floor to help anchor the guide device 1. Each floor section also has a tapered lip section 26 to ease the tires entry onto the guide.

Each side wall 2, 3 has a series of apertures 6, 7 on the top of the walls which will receive a pole 8 having an attached flag 9. The pole 8 can be placed in any of the apertures and serve as a visual guide for a user. Also, it should be understood that a second pole and flag would be used on the right side wall 2, however, it was removed from FIG. 1 for clarity.

Figure 2:
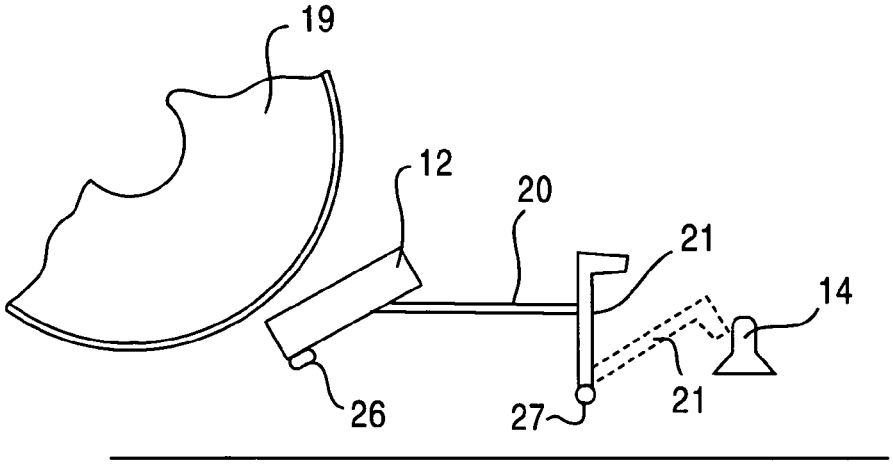
FIG. 2 is a partial view of the present invention showing the bell ringing mechanism.

Each floor section has a bell activator 12, 13 secured thereto. In addition, each guide half has a bell 14 secured thereto in any conventional manner. As shown in FIG. 2, the bell activators 12, 13 are pivoted at 26 so the activator will rotate when engaged by a vehicle tire 19. When the activator is rotated it will move a connecting rod 20 which is connected to a striker 21, when the striker 21 rotates about 27 to the dotted line position shown in FIG. 2, it will hit and activate a bell 14, which will provide an audible indicator for the user of the parking guide 1. It should be noted that the connecting arm 20 and striker 21 have been removed from FIG. 1 for clarity. Also, where or how the bell is mounted on the device is not material as long as the striker can hit it when the activators 12, 13 are hit by the tire(s) of the vehicle.

Secured adjacent each of the backs 24, 25 is a stop ramp 15, 17 which will provide a positive stop for the tires of the vehicle. Mounted to each stop ramp 15, 17 is a reflective surface 16, 18. The reflective surfaces 16, 18 will be mounted at an angle so the headlights of a vehicle will shine into the reflective surfaces when a vehicle is driven into the garage at night. The light will be reflected upwards, because of the angled mount of the reflective surfaces and provide additional light inside the garage.

In order to use the guide 1, a user would decide whether he/she wanted to retain the halves together or separate them. Next, the user would open the access hatch 4, 5 and fill the side walls 2, 3 with a ballast. Next, the user would determine the position for the guide when the vehicle is properly parked, and the guide 1 could be attached in the proper place by the adhesive pads 23. Next a user would decide which aperture 6, 7 would give them the best visual indication and insert the pole 8 into this aperture. As the vehicle is driven into the garage the tire(s) 19 would pass up the ramp(s) 26 onto the floor(s) 10, 11. When the tire(s) 19 hit the activator 12, it will rotate. When the activator 12 is rotated it will move a connecting rod 20 which is connected to a striker 21. When the striker 21 rotates to the dotted line position shown in FIG. 2, it will hit and activate a bell 14, which will provide an audible indicator for the user of the parking guide 1 which will indicate that the tires are in proper position.

After that the tires will strike the stops 15, 17 which will again indicate that the tires are in proper position. The reflective surface(s) 16, 18 will reflect the vehicle lights into the garage if the vehicle is driven into the garage at night.

Although the Vehicle Garage Guard #2 and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A parking guide for indicating that a vehicle is properly positioned, said parking guide comprising:

at least one floor section, said at least one floor section connected to a side wall and a back wall, said side wall having means for supporting a visual parking indicator, said parking guide having means for producing an audible indication that indicates that a vehicle is properly positioned, and wherein said side wall is hollow, and said side wall has means for introducing ballast into said hollow side wall.

2. The parking guide as claimed in claim 1, wherein said means for supporting a visual parking indicator is a series of apertures extending along a top of said side wall.

3. The parking guide as claimed in claim 1, wherein said means for producing an audible indication that indicates that a vehicle is properly positioned comprises an activator, a connecting rod, a striker, and a bell said activator being positioned on said floor section in a path of a vehicle, and said activator being connected to said striker by said connecting rod, said striker being moved from a first position to a second position when engaged by tires of a vehicle, and when in said second position, said striker engages said bell which produces an auditory indication that a vehicle is properly positioned.

4. The parking guide as claimed in claim 1, wherein said at least one floor section has an adhesive means for securing said at least one floor section to a surface.

5. The parking guide as claimed in claim 1, wherein said parking guide has means for reflecting a vehicles headlights in a garage area.

6. The parking guide as claimed in claim 1, in combination with a visual parking indicator, and wherein said visual parking indicator comprises a pole which fits into said means for supporting a visual parking indicator.

7. The parking guide as claimed in claim 6, wherein said visual parking indicator has a flag attached thereto.

8. A parking guide for indicating that a vehicle is properly positioned, said parking guide comprising:

at least one floor section, said at least one floor section connected to a side wall and a back wall, said side wall having means for supporting a visual parking indicator, said parking guide having means for producing an audible indication that indicates that a vehicle is properly positioned, and wherein said parking guide has means for securing said parking guide in position on a surface, said means for securing said parking guide in position on a surface comprising an adhesive means for securing said at least one floor section to a surface, and further comprising ballast in said side wall.

* * * * *